US005213517A

United States Patent [19]

Kerek et al.

[11] Patent Number: 5,213,517

[45] Date of Patent: May 25, 1993

[54] SEPARABLE ELECTRODES WITH ELECTRIC ARC QUENCHING MEANS

[75] Inventors: Leslie Kerek, Los Angeles; Hugh M. Hyatt, Camarillo; Larry L. McCormick, Los Angeles, all of Calif.

[73] Assignee: G & H Technology, Inc., Camarillo, Calif.

[21] Appl. No.: 833,110

[22] Filed: Feb. 10, 1992

[51] Int. Cl.[5] ..... H01R 13/53

[52] U.S. Cl. ..... 439/187; 439/181; 439/886

[58] Field of Search ..... 439/181, 182, 183, 184, 439/185, 186, 187, 693, 886

[56] References Cited

U.S. PATENT DOCUMENTS

| | | | |
|---|---|---|---|
| 2,832,941 | 4/1958 | Willis | 439/693 X |
| 3,740,701 | 6/1973 | Harnden, Jr. | 439/181 X |
| 3,867,602 | 2/1975 | Jawelak | 439/181 X |
| 4,992,333 | 2/1991 | Hyatt | 361/127 X |

FOREIGN PATENT DOCUMENTS

| | | | |
|---|---|---|---|
| 0259180 | 3/1988 | European Pat. Off. | 439/186 |

*Primary Examiner*—Larry I. Schwartz
*Assistant Examiner*—Khiem Nguyen
*Attorney, Agent, or Firm*—George J. Netter

[57] ABSTRACT

An electrical connector (10) has first and second separable contacting electrodes (12, 14) which do not generate an arc on making or breaking. A member (44) interrelates one of the electrodes (14) via a spring-loaded drive cap (24) at ground potential, which member 44 is constructed of a material a wide range of electrical resistance (e.g., insulator to substantial short) inversely response to the magnitude of electric field across the member. On electrode preparation, the drive cap (24) establishes a relative movement of the member (44) with respect to the electrode (14) reducing the member material thickness to such a point that the electric field across the intervening member material reduces the electrical resistance to a desired low level (e.g., short to ground).

10 Claims, 2 Drawing Sheets 10
12
14
16
18
22
24
26
28
30
32
34
36
38
40
41
42
44
46
47
48
50
54
56
58
60

SEPARABLE ELECTRODES WITH ELECTRIC ARC QUENCHING MEANS

BACKGROUND

1. Field of the Invention

The present invention relates generally to separable electrodes arranged in an electrical circuit, and, more particularly, to such electrodes with means for eliminating or suppressing arcing on connecting and disconnecting of the electrodes.

2. Description of Related Art

It is well known that a device having parts physically interrupting an electrical circuit can be subject to arcing in the region of interruption which can damage the device or severely impair its operation. Exemplary of but some of the devices which experience this difficulty are relay points, circuit switches, and plug and receptacle connectors.

Even if the voltages and currents handled by the circuit are maintained at a relatively low level, repeated making and breaking of the device parts, with resulting low level arcing, can have a cumulative undesirable effect. Specifically, such arcing substantially shortens the life of the device part make/break surface due to deterioration of the contact surfaces and also can induce undesirable interference in the operation of interconnected equipment. Pitting and welding of the contacting surfaces from arcing, for example, can also produce electrical circuit difficulties or malfunction.

It is not an unusual requirement that a device for interrupting an electrical circuit be located in an inflammable or combustible environment. Accordingly, it is desirable in that case to eliminate or substantially reduce arcing so as to avoid the possibility of explosion or fire.

It is, therefore, a desideratum to provide a device for arrangement in an electric circuit having parts which make and break circuit connection without producing arcing between the parts. It is also desirable that such means may be readily adaptable for restricted space applications, and be capable of operative utilization in a broad range of environments and over a substantial ambient temperature range.

SUMMARY OF THE INVENTION

Unless specifically identified otherwise, the terms "electrical connector" or just "connector" as used herein shall refer to any device for incorporation into an electrical circuit having separable parts which are apt to produce arcing on making and breaking contact with each other.

In the practice of the present invention an electrical connector having first and second electrodes for interconnection within an electrical circuit includes a member interrelating the first and second electrodes constructed of a material capable of a wide range of electrical resistance resulting from non-linear response to the value of an electric field applied across the material. For simplicity this material will be referred to as just a "non-linear material" or NLM. Specifically, the member contacts both electrical ground at one point and one of the device electrodes at another point with a certain amount of the NLM material located between the two points, which material will be in a relatively high resistance when subjected to no or relatively low electric fields. On, say, initiating relative movement in a direction to break contact between the first and second parts, this produces a corresponding change in member dimension separating the device electrode and ground connection points. This change in dimension continues until the corresponding change in electric field across the NLM reduces the resistance of the member to a desired low state. With the member resistance at this low state the associated device electrode is brought to substantially ground potential or, optionally, to some predetermined potential. The dimensions of the member and device electrodes are such that the grounding occurs before there is full separation of the first and second device parts from each other, and in this way arcing is prevented or substantially reduced. Return of the parts to the fully connected position simultaneously positions the NLM member with a substantially greater amount of member material between the ground connection point and device electrode point so that the NLM member in that region is substantially an insulator or least at a sufficiently high resistance so as to provide an undesirable leak to ground.

A material (i.e., NLM) that can be especially advantageously employed in constructing the member having electric field variable resistance referenced in the first and other embodiments of the invention is that disclosed in U.S. Pat. No. 4,992,333, ELECTRICAL OVERSTRESS PULSE PROTECTION by H. M. Hyatt. Not only does this patented material exhibit varying electrical resistance as a non-linear response to the electric field across the material, but also the material can be made with a wide range of variable resistance and related field response properties.

A further embodiment of the invention pertains to a plug and receptacle connector having pin and socket contacts which can be releasably mated with one another and which contacts would normally risk arcing during mating and unmating. A socket contact for use in this version includes an open-ended hollow metal tube received within an insulator body having an open end through which a pin contact to be described is received.

The pin contact is elongated and has a radial mounting flange adjacent the contact aft end. A portion of the outer surface of the pin from the flange forwardly is coated with a good electrical insulator leaving the pin outer end portion bare for ohmic contact. A conductive drive cap has a central opening of sufficient diameter to permit sliding receipt onto the pin contact.

A body of an electric field controlled variable resistance material or NLM (e.g., Hyatt patent) has an opening for sliding receipt onto the pin contact and an end in good ohmic contact with the drive cap.

A conductive housing for the pin contact has a forward open end and an internal shoulder. Spring means interrelate the shoulder and the drive cap urging the cap forward.

When unmated, the variable resistance body is positioned by the spring to present a minimum thickness of the NLM body material between the drive cap at ground potential and the pin contact bare end portion. Since there is for all intents and purposes a zero electric field across the non-linear body at this time, it will be in a high resistance state.

Mating of the pin and socket contacts compresses the spring means which at the same time increases the thickness of the variable resistance body between the grounded drive cap and the pin contact bare end resulting in a substantially insulative path therebetween, and the pin and socket contacts function as normally intended.

As unmating occurs, the length of variable resistance material between the drive cap and the pin contact decreases to the point where the electric field across the material is such as to effect transition to a low resistance state. The various part dimensions are selected so that the low resistance state is achieved just before there is a complete release of the pin contact from the socket contact thereby grounding the pin contact which prevents arcing from occurring at the moment of full release.

DESCRIPTION OF A PREFERRED EMBODIMENT

Figures 1, 2, 3, 4:
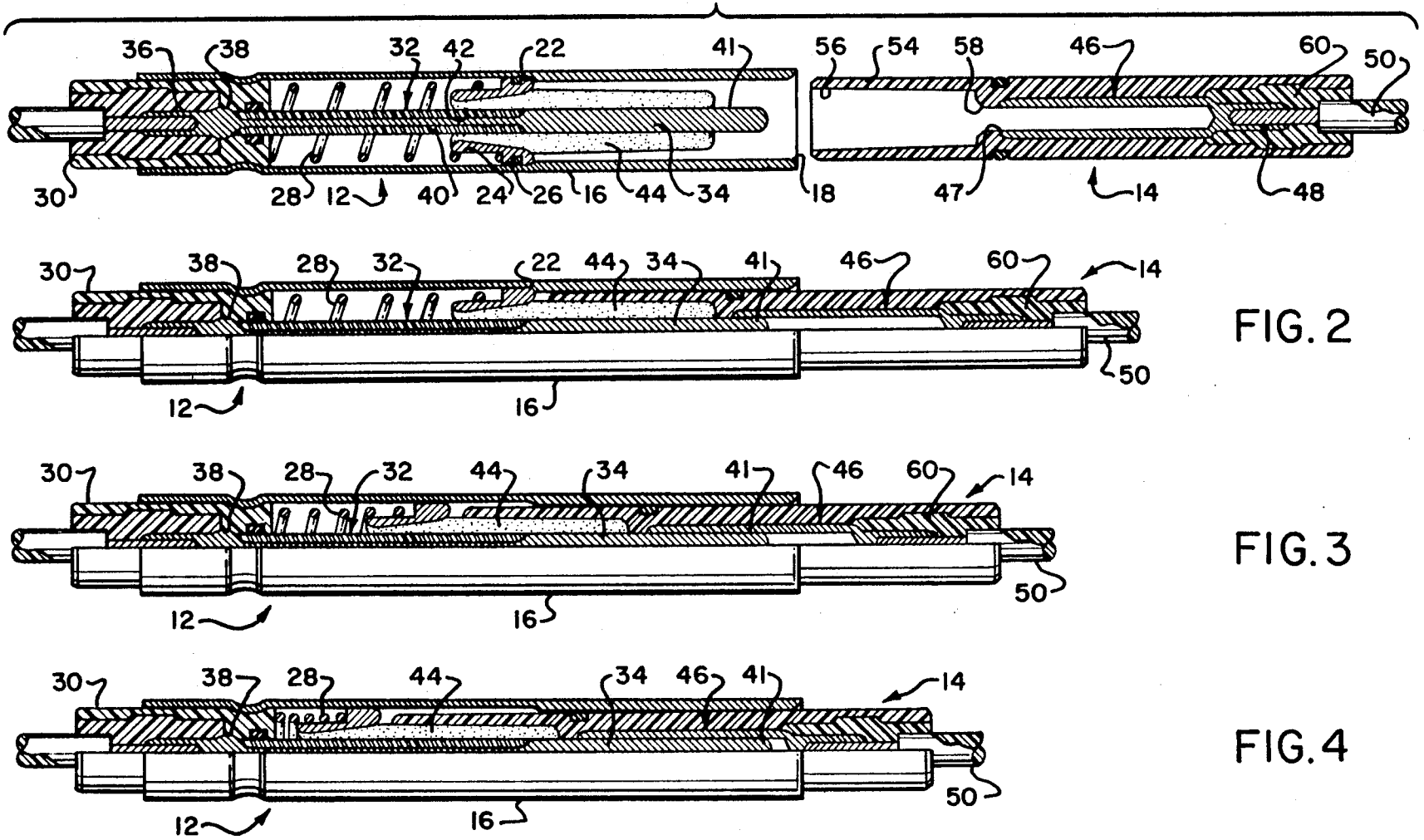
FIG. 1 is a side elevational, sectional view of a first embodiment of the invention showing the parts separated.
FIG. 2 is a view similar to FIG. 1 showing the parts initialing engagement.
FIG. 3 is a view similar to FIG. 1 showing the parts substantially engaged.
FIG. 4 is a view similar to FIG. 1 showing the parts substantially engaged.

Turning now to the drawings and particularly FIG. 1, a first embodiment of the present invention enumerated generally as 10 is shown which is especially advantageous in eliminating arcing at the points of contact and break in a pin and socket connector and, as well, isolating the contact/break region from external environmental inflammable or explosive materials. In its major parts, the invention includes a pin module 12 and socket module 14 releasably joinable together to establish an electrical connection to electrical cable wires interconnected with the pin and socket modules and, in a way that will be more particularly described, further means are provided which coact with the pin and socket modules to prevent arcing.

The pin module 12 includes a cylindrical metal housing 16 having an open forward end 18 via which interconnection with the socket module connector parts is established. Spaced inwardly from the open end on the housing inner wall is a shoulder 22.

A drive cap 24 of generally cylindrical construction has an outwardly extending circular flange 26, the latter having a diameter enabling sliding receipt within the housing 16 inwardly of the shoulder 22. When the drive cap is assembled within the housing 16, a coil spring 28 has one end contacting the flange 26 and the other end contacting an insulative insert 30 which closes off the opposite end of housing 16.

A pin contact 32 has an elongated cylindrical end portion 34 separated from a cable connection portion 36 located at the opposite end by an enlarged radial flange 38. A portion of the outer surface of the cylindrical end portion 34 is coated with an insulative material 40 extending from flange 38 to a predetermined point short of the pin outer end. More particularly, the coating 40 extends forwardly from the flange toward the pin forward end leaving a bare and uncoated portion 41 of sufficient length for interconnection purposes, as will be described. In assembly, the cylindrical end portion 34 of the pin contact passes through an axial opening 42 in the drive cap 24 with the pin flange 38 being mounted within the insulative insert 30 in a conventional manner and the insert secured within housing 16 by crimping, for example.

A tubular member 44 constructed of a material such as an NLM capable of residing in two substantially different electrical resistance states dependent upon the magnitude of an electric field placed across the member is received on the pin contact end portion 34 and has its inner end secured within the opening 42 in the drive cap 24 in good ohmic contacting relation. More particularly, this material as described in Hyatt U.S. Pat. No. 4,992,333 assigned to the same assignee as the present application consists of specific compositions of semiconducting materials, and either or both conductive and insulative materials which have the unique and advantageous property of possessing radically large range of resistances depending upon electrical field applied across the material. In a first or low electrically stressed state, the material is substantially insulative whereas in a second or highly electrically stressed state, the material resistance drops to that of a good conductor. As will be made clearer, it is the unique property of this material which is relied upon to achieve the arc diminuation or quenching features of the present invention.

The socket module 14 includes a socket contact 46 consisting of an elongated metal tube having an internal bore of diameter which closely approximates that of the pin contact cylindrical end portion 34. The internal bore opens outwardly at one end 47 and the end 48 opposite the open end is adapted in conventional manner for having an electric cable 50 secured thereto either by crimping or soldering, for example. An insulative, generally cylindrically shaped body 54 has a somewhat conically shaped opening 56 at what is the socket module forward end, which opening communicates with the enclosed socket contact 46 via a smaller diameter opening 58. The outer diameter of the insulative body 54 is such as to enable sliding receipt within the open end of the pin module housing 16. An insulative insert 60 secures the connection end of the socket contact within the body 54.

With the connector parts fully unmated as shown in FIG. 1 it is seen that the drive cap 24 is positioned fully forward by the coil spring 28 to abut against the shoulder 22. Since the pin contact 32 at all times remains in fixed relationship to the housing 16, the forward part of the drive cap 24 is now located just opposite the forward end of the insulative coating 40. Accordingly, with the drive cap permanently set to electrical ground, the distance measured through the variable resistance material composing the member 44 provides minimum spacing between the conductive surface of the pin bare portion and ground. At this time, the electric field on the variable resistance material therebetween will depend primarily upon whatever electric field is generated by the pin. That is, if there is zero potential on the pin contact due to its connection with other circuit apparatus, then the resistance across the NLM member will be rather high. On the other hand, if there is a voltage on the pin contact then an electric field will be exerted across the NLM member and the resistance will be substantially reduced, perhaps even to a pin to ground short.

To mate the connector parts, the pin module 12 and socket module 14 are moved together along their common axis so that the pin contact 32 is received and positioned within socket contact 46 as shown in FIG. 2. During mating as shown in FIGS. 2–4, since the pin contact remains fixed with respect to its outer housing 16, the forward end of the insulative body 54 moves the drive cap 24 against the coil spring 28, compressing it, and positioning the drive cap well within and away from the outer end of the pin module housing 16. It is important to note at this time that the amount of the material composing the variable resistance member 44 between the grounded drive cap 24 and the bare surface portion 41 of the pin contact is substantially greater than it was or is during the unmated mode (Cf. FIG. 1). Accordingly, the electric field on the material composing the member 44 between the mentioned parts is insufficient to reduce the resistance from its electrically unstressed normally high resistance state which is substantially that of an insulator.

As the connector is moved from its mated condition (FIG. 4) to the unmated condition (FIG. 1), this releases the drive cap 24 allowing it to move forward towards the open end of the pin module housing until the fully unmated condition, both mechanically and electrically, is reached once again.

Figure 5:
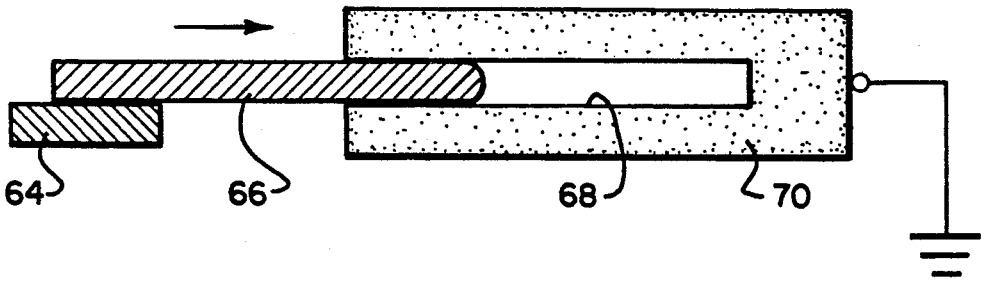
FIG. 5 depicts a side elevational, sectional view of a second embodiment.

Although the first described embodiment relates primarily to arc quenching a pin and socket connector, it is contemplated that the present invention can be advantageously employed with a great variety of switching means for arc quenching purposes. FIG. 5 depicts a second embodiment in which two contacting electrodes 64 and 66 incorporated within an electric circuit (not shown) are desired to be separated without generating an arc on electrode 66 moving in the direction of the arrow. The forward end of electrode 66 is contactingly received within the bore 68 of a tubular member 70 constructed of a field responsive variable resistance material (e.g., Hyatt patent) the closed end of which is grounded. As the electrode separation movement (arrow) progresses the amount of the variable resistance material between electrical ground and the end of electrode 66 decreases. Just before the electrodes separate, the variable resistance member 70 experiences a transition to its resistance state preventing arcing on full electrode separation occurring.

Figure 6:
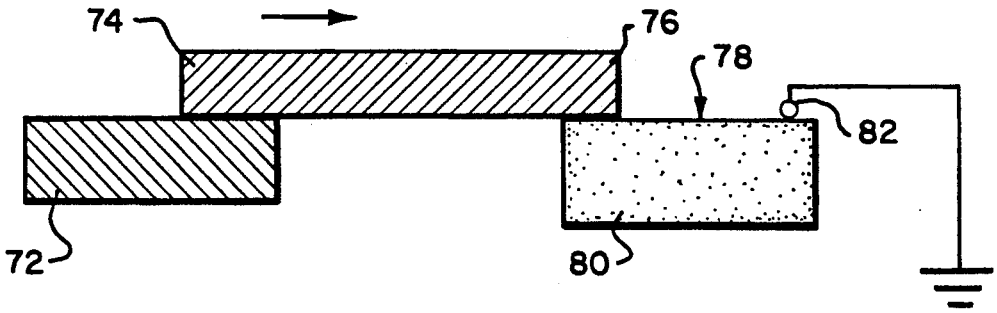
FIG. 6 is a sectional, elevational view of a third embodiment.

FIG. 6 shows another or third embodiment in which electrodes 72, 74 in a power circuit (not shown) are separated by movement of electrode 74 in the direction of the arrow. The outer end 76 of electrode 74 slides along a surface 78 of a field responsive variable resistance body 80 having a ground connection 82 on the same surface. As the electrode separation movement continues the variable resistance material between electrode end 76 and ground connection 82 decreases with a concomitant electric field increase across the intervening material. This continues until just before electrode separation where the electric field is such as to produce a resistance transition to the low resistance state preventing arc generation. During the fully connected state of the electrodes the resistance between 76 and ground is in the insulator range. In this version, the forward edge 76 of electrode 74 may be designed to be located at any desired spacing from the ground connection on electrode separation and thus with a desired predetermined amount of resistance achieved upon full electrode separation. Optionally, the forward edge 76 may end up in direct contact with ground, leaving the electrode 74 grounded when unmated with electrode 72.

Figure 7:
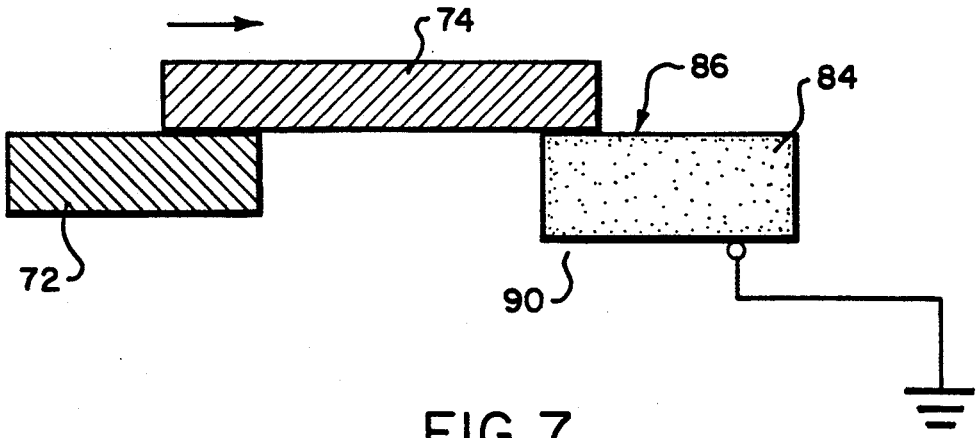
FIG. 7 is a sectional, elevational view of a fourth embodiment.

The FIG. 7 version or fourth embodiment differs from that of FIG. 6 in that the body of variable resistance 84 is generally platelike and while the electrode 74 slides along one major surface 86 of the body, the ground connection 88 is made to the opposite major surface 90. In this case, the circuit path to ground through the NLM member 90 is a diagonal line from the forward end of electrode 74 to the ground connection.

The field responsive variable resistance material of the Hyatt patent can, as a result of a compositional variation, provide variable transition rates over a considerable range for use in applications requiring special transition rates. Also, certain applications may require substantially a dead short to ground to prevent arcing while other applications may only require reduction of the resistance to some predetermined finite value and this can be provided by a compositional change of the variable resistance material as well as dimensional change of the various device parts.

Although the invention has been described in connection with a preferred embodiment it is understood that those skilled in the appertaining art may produce modifications which come within the spirit of the invention as disclosed and within the ambit of the appended claims.

What is claimed is:

1. An electrical connector including a first connector part having a pin contact with an end for mating connection with a second connector part having a socket contact, comprising:

an insulative coating on a part of the pin contact peripheral surface leaving an outer end portion of said pin contact free from said coating to enable mating connection with the socket contact;

cap means received on said pin contact resiliently urged toward the end of said pin contact, said cap means being maintained at ground potential; and a body of a material which can exist in a first relatively high electrical resistance state when subjected to little or no electric field and in a second relatively low electrical resistance state when subjected to more than a predetermined amount of electric field, said body having an opening for sliding receipt of the pin contact therewithin and having one end thereof conductively and physically secured to the cap means for unitary movement therewith;

said body providing an interconnection between the cap means and the bare end portion of the pin contact, and wherein the body exists in said first relatively high resistance state when the connector parts are mated and the body exists in said second relatively low resistance state when the connector parts are unmated.

2. An electrical connector as in claim 1, in which the pin contact, cap means and body are located within a tubular housing having an internal shoulder and an insulative insert, said cap means being movable between the shoulder and insert; and spring means having one end contacting the insert and an other end contacting the cap means urging said cap means into contact with the shoulder when the connector parts are unmated.

3. An electrical connector as in claim 2, in which the spring means includes a coil spring.

4. An electrical connector as in claim 1, in which the insulative coating is a Teflon film.

5. An electrical connector as in claim 1, in which the body is so dimensioned as to continuously contact the pin contact as it slides therealong.

6. An electrical connector as in claim 1, in which the pin is elongated with an axis and the body has a uniform wall thickness about the body opening and when the connector is unmated substantially a single wall thickness of the body separates the cap means and the peripheral surface of the pin contact free from insulative coating as measured substantially normally to the pin longitudinal axis.

7. An electrical connector as in claim 1, in which the cap means has an opening therein and an end portion of the body is ohmically secured within the cap means opening for unitary movement therewith.

8. An electrical connector as in claim 1, in which the body relatively high resistance has a value substantially that of an insulator and the body relatively low resistance is substantially an electrical short.

9. An electrical connector as in claim 1, in which the body relatively low resistance has some prescribed magnitude greater than an electrical short.

10. An electrical connector as in claim 1, in which the body experiences a transition from the relatively high resistance state to the relatively low resistance state immediately before the pin and socket fully separate from one another.

* * * * *